US005623720A

United States Patent [19]

Howe et al.

[11] Patent Number: 5,623,720

[45] Date of Patent: Apr. 22, 1997

[54] METHOD AND APPARATUS FOR STRIPPER BAR ROTATION

[75] Inventors: Richard L. Howe; Leon G. Poplawski; Joseph Rozansky, all of Webster, N.Y.

[73] Assignee: Xerox Corporation, Stamford, Conn.

[21] Appl. No.: 720,523

[22] Filed: Sep. 30, 1996

[51] Int. Cl.[6] ..... G03G 15/20

[52] U.S. Cl. ..... 399/323

[58] Field of Search ..... 399/323, 398, 399/399; 271/307, 308, 311–313, 900

[56] References Cited

U.S. PATENT DOCUMENTS

| | | |
|---|---|---|
| 4,336,992 | 6/1982 | Szlucha et al. . |
| 4,475,804 | 10/1984 | Kanno et al. . |
| 4,571,056 | 2/1986 | Tani et al. . |
| 4,771,310 | 9/1988 | Leo et al. . |
| 4,866,485 | 9/1989 | Simpson . |
| 5,239,349 | 8/1993 | Hoover et al. . |
| 5,315,359 | 5/1994 | Nishikawa . |

FOREIGN PATENT DOCUMENTS

| | | |
|---|---|---|
| 58-196564 | 11/1983 | Japan . |
| 59-204072 | 11/1984 | Japan . |
| 60-000477 | 1/1985 | Japan . |
| 04-136969 | 5/1992 | Japan . |
| 06-110337 | 4/1994 | Japan . |

*Primary Examiner*—Robert Beatty

[57] ABSTRACT

Disclosed is a novel method and apparatus for rotating a stripper bar associated with a paper path. A cam and cable mechanism replaces a rigid link mechanism on the stripper bar, the cam and cable mechanism providing for a much greater angle of rotation of the stripper bar than the rigid link mechanism. The additional rotation allows the stripper fingers on the stripper bar to be rotated completely out of the way of a paper jam clearance path. Other new developments include a wrench positioning system that controls the orientation of the stripper bar and an over-rotation prevention system that stops the rotation of the stripper bar when the stripper bar and stripper fingers are being serviced.

20 Claims, 8 Drawing Sheets

METHOD AND APPARATUS FOR STRIPPER BAR ROTATION

This invention relates to a stripper finger bar assembly for printers and duplicators and more specifically a stripper finger bar assembly for a fuser assembly which allows for easy access to paper jam areas.

BACKGROUND OF THE INVENTION

In printers and duplicators commonly in use today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with toner. Most development systems employ a developer material which comprises both charged carrier particles and charged toner particles which triboelectrically adhere to the carrier particles. During development the toner particles are attracted from the carrier particles by the charge pattern of the image areas on the photoconductive insulating area to form a powder image on the photoconductive area. This image is subsequently transferred to a support surface such as copy paper to which it is permanently affixed. Following transfer of the toner image to a support surface, the photoconductive insulating member is cleaned of any residual toner that may remain thereon in preparation for the next imaging cycle.

One of the more conventional approaches to fixing the toner image is through the use of heat and pressure by passing the print substrate containing the unfused toner image through a nip created between a pair of opposed roller members, at least one of them being heated and normally referred to as the fuser roll, and the other being pressed against the fuser roll and normally referred to as the pressure roll. During this procedure, the temperature of the toner material is elevated to a temperature at which the toner material coalesces and becomes tacky. This heating causes the toner to flow to some extent into the fibers or pores of the substrate. Thereafter, as the toner material cools, solidification of the toner material causes it to become bonded to the substrate. Typical of such fusing devices are two roll systems wherein the fuser roll is coated with a material such as silicone rubber or other low surface energy elastomer. The silicone rubbers that can be used as the surface of the fuser roll include room temperature vulcanizable silicones referred to as RTV silicones, liquid injection moldable or extrudable silicone rubbers, and high temperature vulcanizable silicones referred to as HTV silicones.

During the fusing process, and despite the use of low surface energy materials for the fuser roll surface, there is a tendency for the copy substrate to remain tacked to the fuser roll after passing through the nip between the fuser roll and the pressure roll. When this happens, the tacked print copy substrate does not follow the normal substrate path but rather continues in an arcuate path around the fuser roll, eventually resulting in a paper jam which will require operator involvement to remove the jammed paper before any subsequent printing cycle can proceed. Such a jammed piece of paper can also lead to a damaged fuser roll, a condition that requires a trained service technician to replace the roll, which is an expensive procedure. As a result it has been common practice to use one or more techniques to ensure that the print substrate is stripped from the fuser roll downstream of the fuser nip. One of the common approaches has been the use of a stripper finger or a plurality of stripper fingers placed in contact with the fuser roll to strip the print substrate from the fuser roll. Normally, the shape of the fingers, and their location and orientation relative to the fuser roll, are very important to their function, especially in the case of flexible stripper fingers. Still, even with the use of stripper fingers, a copy substrate can become jammed in the fuser assembly and when this occurs, the stripper fingers must be moved away from the jammed paper in order for the area of the paper jam to be accessible to an operator for clearance.

In a current fuser assembly, stripper fingers are mounted on a rotatable stripper finger mounting bar which moves the stripper fingers away from the fuser roll when the fuser assembly top cover is opened. However, the degree of rotation of the mounting bar is limited and at the end of the full rotation of the mounting bar the stripper fingers are still exposed to operator manipulation and/or damage during the process of clearing the jammed paper from the paper path. Due to the easily deformable nature of some types of stripper fingers and the criticality of maintaining their design-intent shape and orientation, it is desirable to keep the stripper fingers out of the jam clearance path of the casual operator in order to minimize their potential damage during jam clearance.

The following disclosures may be relevant to various aspects of the present invention:

U.S. Pat. No. 4,336,992

Inventor: Szlucha et al.

Issued: Jun. 29, 1982

U.S. Pat. No. 4,771,310

Inventor: Leo et al.

Issued: Sep. 13, 1988

Some relevant portions of the foregoing disclosures may be briefly summarized as follows:

U.S. Pat. No. 4,336,992 teaches a stripper apparatus for a fuser roll in the form of a flexible finger structure. The stripper fingers contact the surface of the heated fuser roll and are sufficiently flexible so that when a misstrip occurs they can be deflected out of contact with the fuser roll and partially rotated thereby. The fingers are mounted for 360 degree rotation partially by the heated fuser roll and, in part, manually.

U.S. Pat. No. 4,771,310 discloses a stripper finger mechanism with flexible stripper fingers arranged so that the finger ends are angled against a fuser roll surface to effect initial separation of a fused copy sheet. The fingers have centrally located raised edges to provide a gradually sloping rigid support which lifts the fused copy sheet following initial separation.

The above references are hereby incorporated by reference.

SUMMARY OF THE INVENTION

One aspect of the invention is drawn to an apparatus for moving a stripper bar assembly near a paper path including a housing; a stripper bar having a first end and a second end, with the at least one stripper finger attached thereto, the stripper bar being rotatably mounted in the housing and near the paper path; a cam member located at the first end of the stripper bar; a cable having a first end and a second end, the first end of the cable attached to the cam member; and a moving member which moves from a first location to a second location, the second end of the cable being attached to the moving member so that when the moving member moves from the first location to the second location, the stripper bar rotates in a first direction and moves the at least one stripper finger away from the paper path.

Another aspect of the invention is drawn to a method of moving a stripper bar near a paper path including rotatably mounting the stripper bar in a housing, the stripper bar having at least one stripper finger attached thereto and a cam on a first end thereof; attaching a cable with a first end and a second end, the first end of the cable being attached to the cam end of the stripper bar and the second end of the cable being attached to a moving member; and moving the moving member from a first location to a second location, which causes the stripper bar to rotate in a first direction from a first position to a second position, causing the at least one stripper finger to move away from the paper path.

In an existing fuser assembly, a rigid link connects the stripper bar to the top cover of the fuser assembly so that when the top cover is opened, the stripper bar rotates and moves the stripper fingers away from the fuser roll and away from the potential location of a jammed piece of paper. However, in the rigid link configuration, the rotation of the stripper bar is limited and does not sufficiently move the stripper fingers out of the way of an operator trying to clear the paper path. The present invention solves the limited stripper bar rotation problem by replacing the rigid link connection with a cam and cable connection. The cam and cable connection results in a greater degree of rotation of the stripper bar with the same degree of rotation of the top cover which allows the stripper fingers to be moved completely out of the way of an operator clearing a paper jam in the fuser assembly. Additional developments resulting from the extended rotation of the stripper bar include a wrench positioning assembly which is used to properly position the mounting bar during service operations and an over-rotation prevention feature.

BRIEF DESCRIPTION OF DRAWINGS

Other features of the present invention will become apparent as the following description proceeds and upon reference to the drawings, in which.

Figure 1:
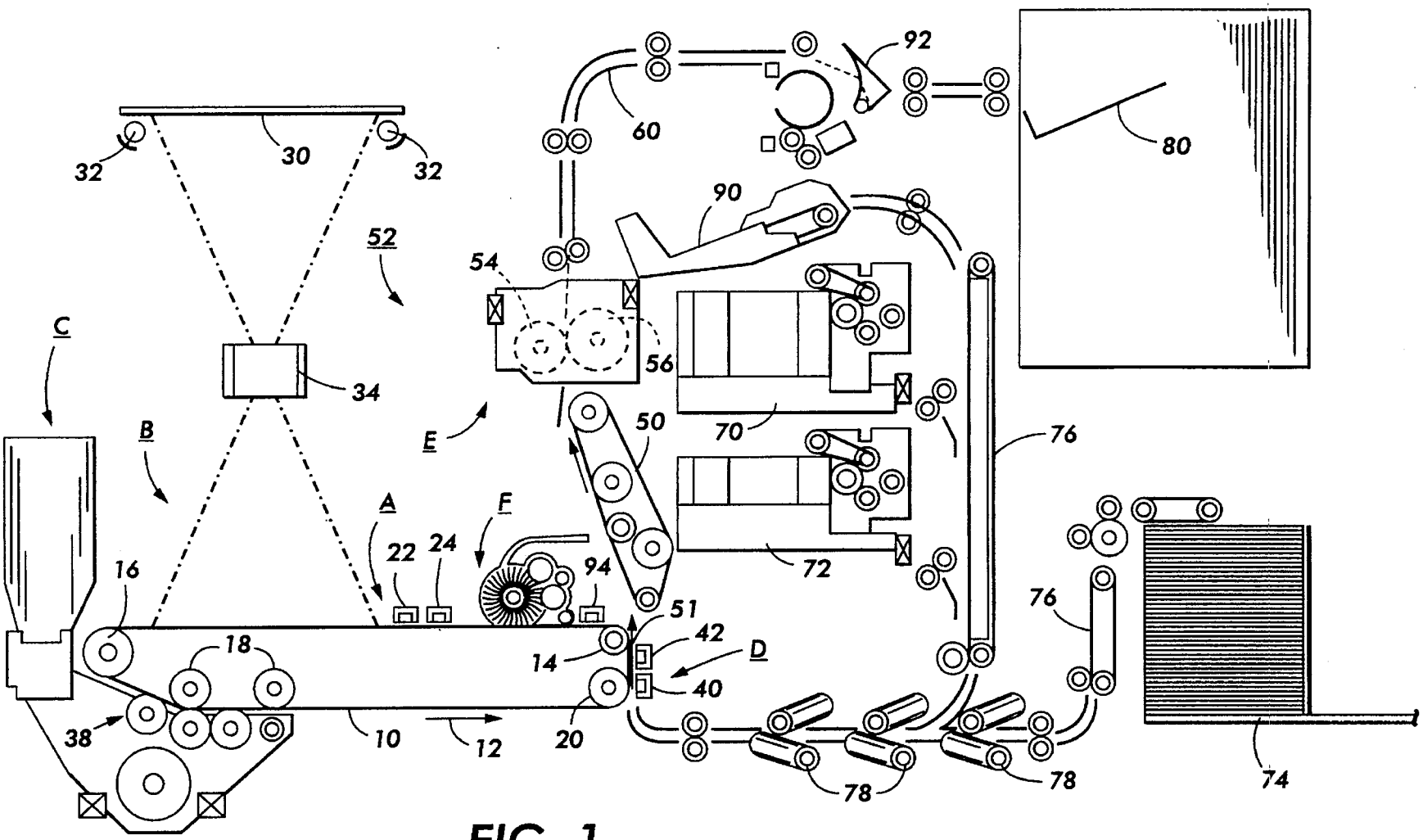
FIG. 1 is a schematic view of an electrophotographic copying machine.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Referring now to the drawings, where the showings are for the purpose of describing a preferred embodiment of the invention and not for limiting same, the various processing stations employed in the reproduction machine illustrated in FIG. 1 will be described only briefly. It will no doubt be appreciated that the various processing elements also find advantageous use in electrophotographic printing applications from an electronically stored original.

A reproduction machine in which the basic principles of the present invention finds advantageous use utilizes a photoreceptor belt 10. Belt 10 moves in the direction of arrow 12 to advance successive portions of the belt sequentially through the various processing stations disposed about the path of movement thereof.

Belt 10 is entrained about stripping roller 14, tension roller 16, idler rollers 18, and drive roller 20. Drive roller 20 is coupled to a motor (not shown) by suitable drive means such as a belt.

Belt 10 is maintained in tension by a pair of springs (not shown) resiliently urging tension roller 16 against belt 10 with the desired spring force. Both stripping roller 14 and tension roller 16 are rotatably mounted. These rollers are idlers which rotate freely as belt 10 moves in the direction of arrow 12.

With continued reference to FIG. 1, initially a portion of belt 10 passes through charging station A. At charging station A, a pair of corona devices 22 and 24 charge photoreceptor belt 10 to a relatively high, substantially uniform negative potential.

At exposure station B, an original document is positioned face down on a transparent platen 30 for illumination with flash lamps 32. Light rays reflected from the original document are reflected through a lens 34 and projected onto a charged portion of photoreceptor belt 10 to selectively dissipate the charge thereon. This records an electrostatic latent image on the belt which corresponds to the informational area contained within the original document.

Thereafter, belt 10 advances the electrostatic latent image to development station C. At development station C, a developer unit 38 advances one or more colors or types of developer mix (i.e. toner and carrier granules)into contact with the electrostatic latent image. The latent image attracts the toner particles from the carrier granules thereby forming toner images on photoreceptor belt 10. As used herein, toner refers to finely divided dry ink, and toner suspensions in liquid.

Belt 10 then advances the developed latent image to transfer station D. At transfer station D, a sheet of support material such as a paper copy sheet is moved into contact with the developed latent image on belt 10. First, the latent image on belt 10 is exposed to a pretransfer light from a lamp (not shown) to reduce the attraction between photoreceptor belt 10 and the toner image thereon. Next, corona generating device 40 charges the copy sheet to the proper potential so that it is tacked to photoreceptor belt 10 and the toner image is attracted from photoreceptor belt 10 to the sheet. After transfer, a corona generator 42 charges the copy sheet with an opposite polarity to detack the copy sheet from belt 10, whereupon the sheet is stripped from belt 10 at stripping roller 14. The support material may also be an intermediate surface or member, which carries the toner image to a subsequent transfer station for transfer to a final substrate. These types of surfaces are also charge retentive in nature. Further, while belt type members are described herein, it will be recognized that other substantially non-rigid or compliant members may also be used with the invention.

Sheets of support material are advanced to transfer station D from supply trays 70, 72 and 74, which may hold different quantities, sizes and types of support materials. Sheets are advanced to transfer station D along conveyor 76 and rollers 78. After transfer, the sheet continues to move in the direction of arrow 51 onto a conveyor 50 which advances the sheet to fusing station E.

Fusing station E includes a fuser assembly, indicated generally by the reference numeral 52, which permanently affixes the transferred toner images to the sheets. Preferably, fuser assembly 52 includes a heated fuser roller 54 and a pressure roller 56 with the toner image on the copy sheet contacting fuser roller 54. The pressure roller 56 abuts the fuser roller 54 to provide the necessary pressure to fix the toner image to the copy sheet.

Chute 60 guides the advancing sheet to catch tray 80 or a finishing station for binding, stapling, collating, etc. and removal from the machine by the operator. Alternatively, the sheet may be advanced to a duplex tray 90 via duplex gate 92 from which it will be returned to the processor and conveyor 76 for receiving second side images.

A pre-clean corona generating device 94 is provided for exposing the residual toner and contaminants (hereinafter, collectively referred to as toner) to corona to thereby narrow the charge distribution thereon for more effective removal at cleaning station F. It is contemplated that residual toner remaining on photoreceptor belt 10 after transfer will be reclaimed and returned to the developer station C by any of several well known reclaim arrangements.

As thus described, a reproduction machine in accordance with the present invention may be any of several well known devices. Variations may be expected in specific processing features, paper handling and control arrangements without affecting the present invention.

Figure 2:
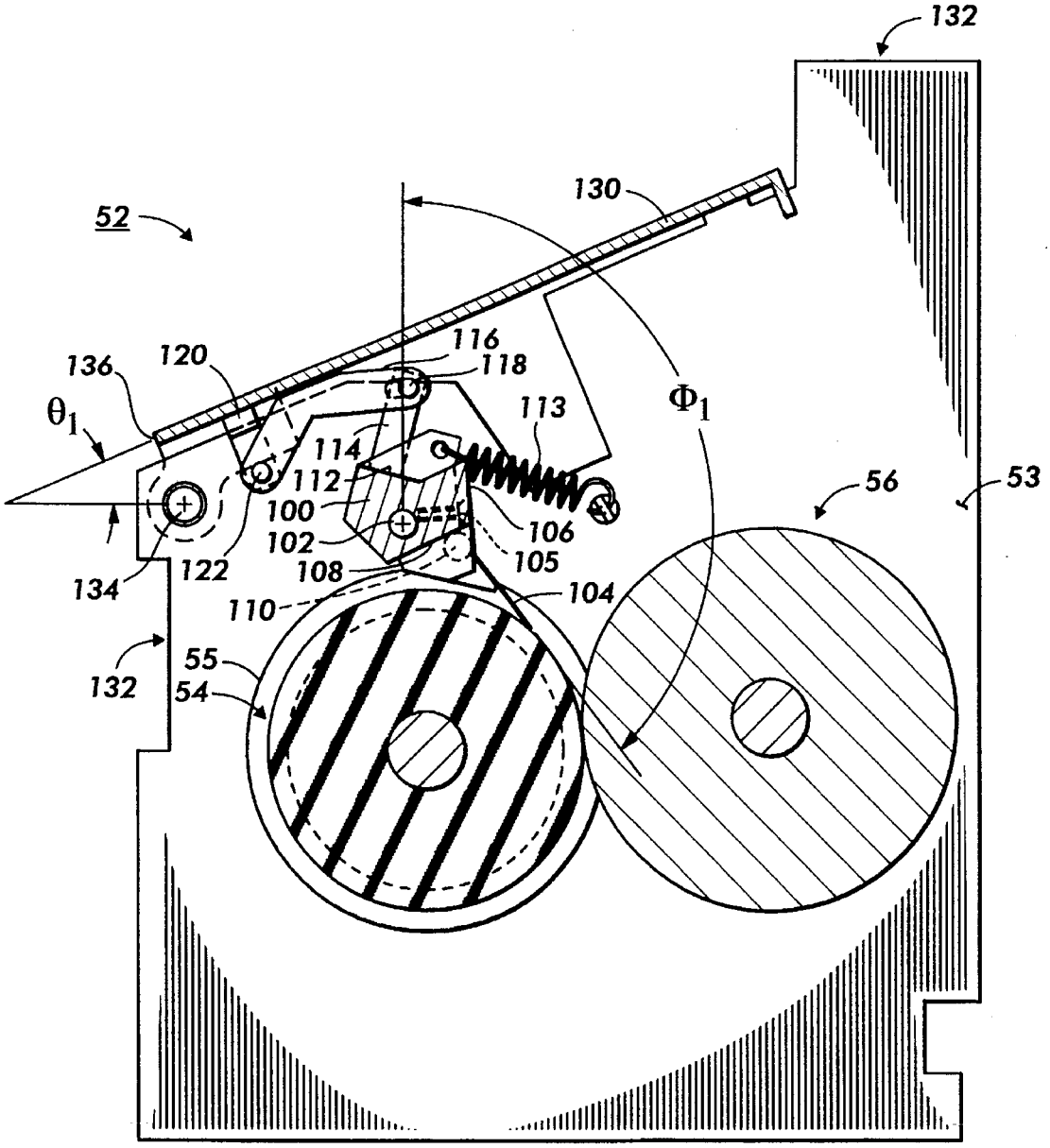
FIG. 2 PRIOR ART
FIG. 2 is a side view of the prior art rigid link connection with the top cover closed.

FIG. 2 shows the prior art stripper bar and rigid link support mechanism. The fuser roll 54 is supported in the fuser assembly 52 at both ends by fuser bearings 55, which in turn are supported by holes in fuser roll side supports 53. Stripper bar 100 is an elongated member which extends along the length of fuser roll 54. Stripper bar 100 is pivotably supported by fuser roll side supports 53 at stripper bar pivot 102. A single or a plurality of stripper fingers 104 are mounted to stripper bar front 106 with stripper finger connecting elements 105. Connecting elements 105 can be in the form of any fastener that allows for easy replacement of the stripper fingers and in the embodiment shown are screws. Stripper bar base 108 is configured so that when the stripper fingers are in their proper operating position stripper bar base 108 rests on stop pin 110. Stop pin 110 is also mounted to fuser side supports 53. Springs 113 at both ends of the fuser roll have one end attached to the stripper bar 100 and the other end attached to fuser roll side supports 53 and bias the stripper bar towards stop pin 110 so that stripper bar base 108 comes into contact with stop pin 110. The stop pin stops the stripper bar clockwise rotation and locates the stripper bar, and thus the stripper fingers, in the correct operating position.

The stripper bar is connected to top cover 130 by a rigid link mechanism so that when the top cover is opened, the stripper bar rotates, moving the stripper fingers in a counter-clockwise direction away from fuser roll 54. Stripper bar top 112 has a stripper bar link 114 with one end rigidly attached to the stripper bar, and the other end to a link lever 116 at stripper bar link pivot 118. The other end of link lever 116 is connected to top cover link 120 at top cover link pivot 122. The end of top cover link 120 opposite top cover link pivot 122 is rigidly attached to top cover 130. Top cover 130 is pivotably mounted to fuser assembly frame 132 at top cover pivot 134. Top cover 130 has a top cover side 136 associated with the pivoting end of the top cover.

In the top cover closed position, an angle theta, $\theta$, is made between the top cover and a horizontal line such as one through the top cover pivot 134 and an angle phi, $\phi$, is made between stripper finger 104 and a vertical line such as one through stripper finger pivot 102. In the embodiment shown, $\theta 1$ is approximate 23 degrees and $\phi 1$ is approximately $-150$ degrees.

Figure 3:
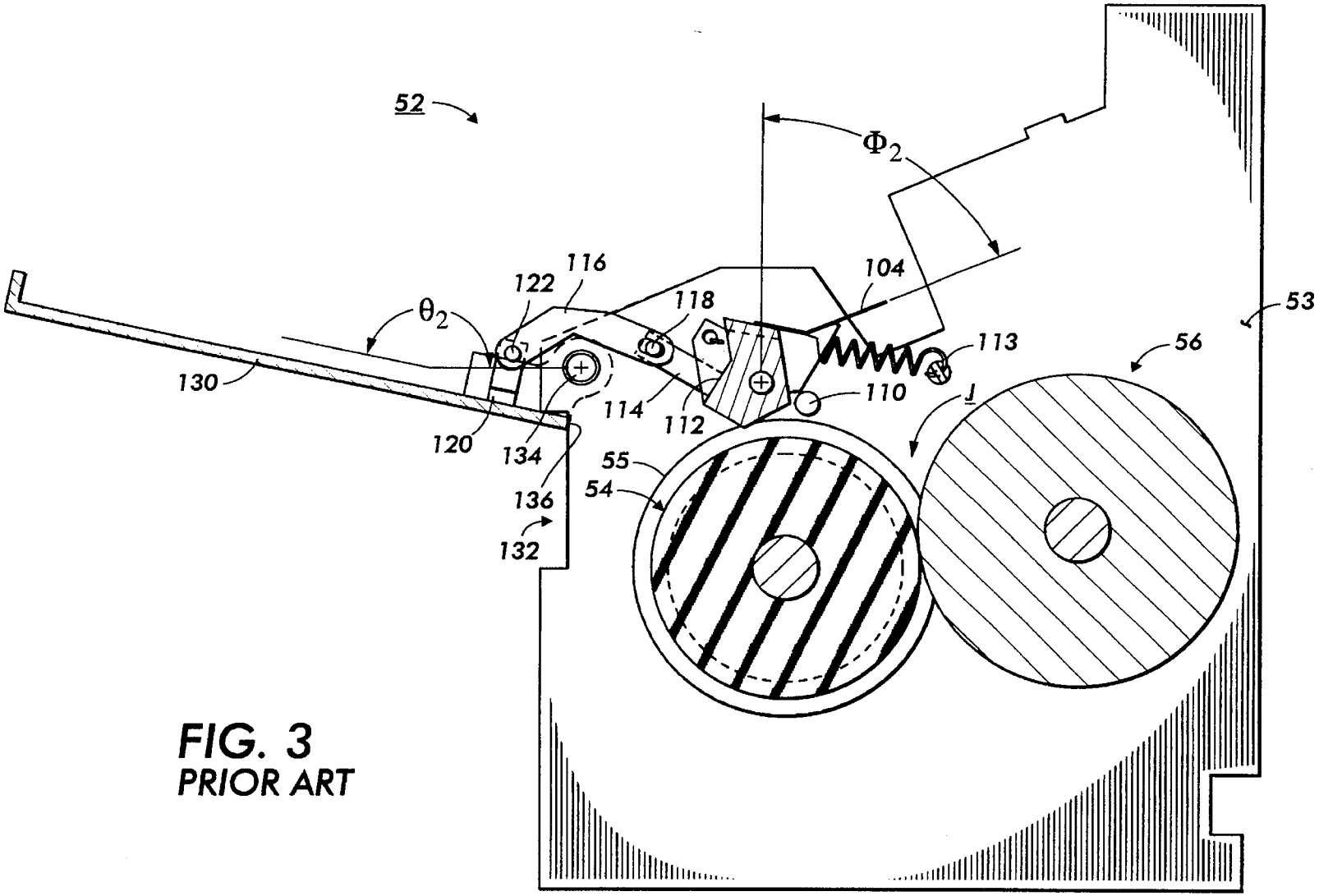
FIG. 3 PRIOR ART
FIG. 3 is a side view of the prior art rigid link connection with the top cover opened.

FIG. 3 shows the same rigid link configuration as FIG. 2, however with top cover 130 of fuser assembly 52 in the open position. Top cover side 136 rests against a rail (not shown) which is mounted on the side of fuser frame 132, stopping the rotation of the top cover and thus that of the stripper bar. The weight of top cover 130 is sufficient to overcome the force of the springs biasing the stripper fingers towards the fuser roll so that the top cover remains in the opened position.

In the fully open position, a new theta angle, $\theta 2$, is approximately 169 degrees and the new phi angle, $\phi 2$, is approximately$-72$ degrees. Thus the difference between $\theta 1$ and $\theta 2$, the top cover rotation, is 146 degrees and the difference between $\phi 1$ and $\phi 2$, the stripper bar rotation, is 78 degrees. As can be seen, the 78 degrees of rotation of stripper bar 100 results in stripper fingers 104 limiting the access to jammed paper area J. As explained above, stripper fingers 104 are made of flexible material and their shape and orientation is critical for proper stripping of the paper from the fuser roll. It is desirable to move stripper fingers 104 completely out of the paper jam path so that an operator clearing the jam will not come into contact with the stripper fingers, nor will the paper being cleared contact the stripper fingers.

Figure 4:
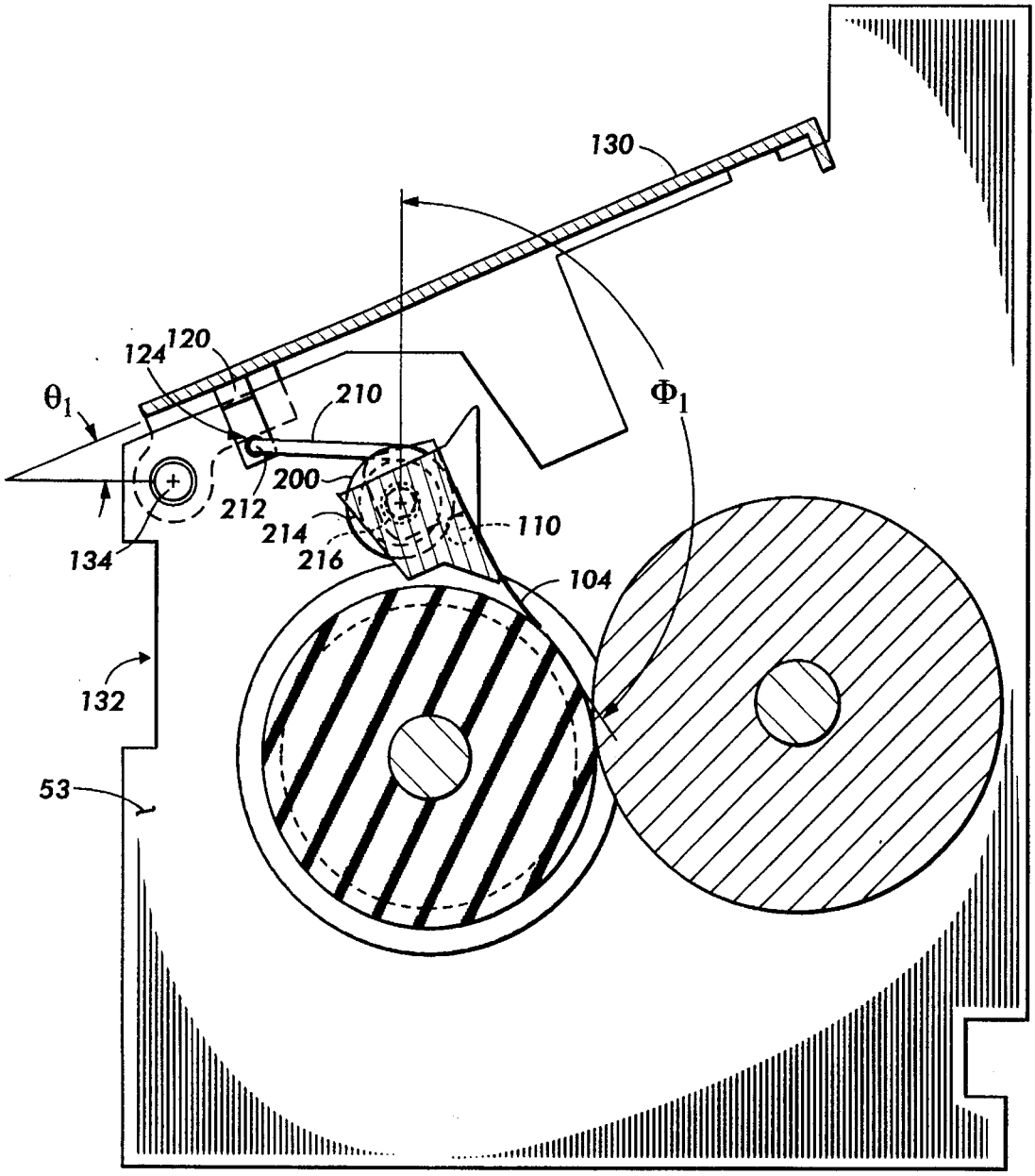
FIG. 4 is a side view of the cam and cable connection with the top cover closed.

The cam and cable mechanism of the present invention is shown in FIG. 4. The rigid link mechanism has been replaced with a cam 200 on one end of stripper bar 100 and a cable 210 connecting the cam to top cover link 120. Cable 210 is releasably attached to top cover link 120 at aperture 124 by pin 212 at one end, the other end being attached to the cam at 214. The cable is wrapped around the cam as shown. A torsion spring 216 is attached at the end of the stripper bar opposite the cam end and is used to bias stripper fingers 104 towards the fuser roll by rotating the stripper bar to its operating position when the top cover 130 is in the closed position. Again, stop pin 110 stops the rotation of stripper bar 100 when stripper bar base 108 abuts it so that stripper fingers 104 are properly positioned with respect to the fuser roll. Angles θ1 and ϕ1 are the same as in FIG. 2; ϕ1 is about 23 degrees and ϕ1 is about −150 degrees.

Figure 5:
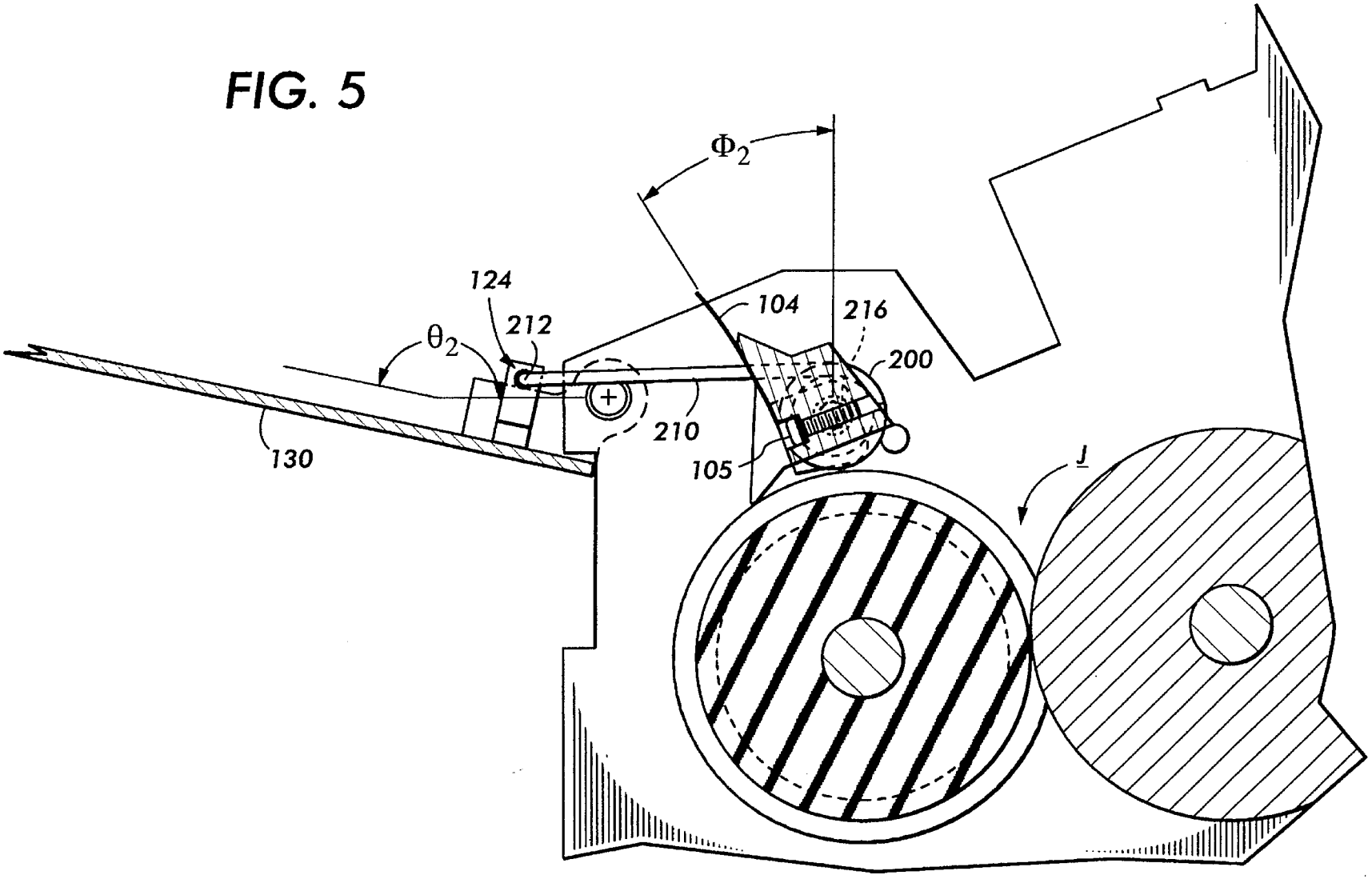
FIG. 5 is a side view of the cam and cable connection with the top cover opened.

FIG. 5 shows cover top cover 130 in the open position. As the top cover 130 opens, the cable 210 unwraps from the cam 200 and rotates the stripper bar 100 as well as causing the torsion spring 216 to tighten. In the fully open position, the new theta angle, θ2, is again approximately 169 degrees. However, the new phi angle, ϕ2, is approximately 32 degrees. The difference between θ1 and θ2, the top cover rotation, being 146 degrees and the difference between ϕ1 and ϕ2, the stripper bar rotation, being 182 degrees. The increased angle of rotation of the stripper bar moves stripper fingers 104 well out of the way of access to paper jam area J.

In implementing the cam and cable mechanism of the present invention, additional features were developed to aid in servicing the fuser assembly. The first of these concerns servicing of the stripper fingers. When replacing the stripper fingers, which is a frequent operation, it is necessary to rotate the stripper bar such that the stripper finger connecting elements 105 holding the stripper fingers to the stripper bar are accessible to the service person. This requires that the tops of the connecting elements 105 point more or less vertically up when the fuser top cover is open. However, with the cable connected and the top cover open, the screws point below the horizontal and to the left and are inaccessible to the service person. Thus, it is necessary to disconnect the cable, allowing the stripper bar to rotate back to the point where the tops of the connecting elements 105 are accessible.

Figure 6:
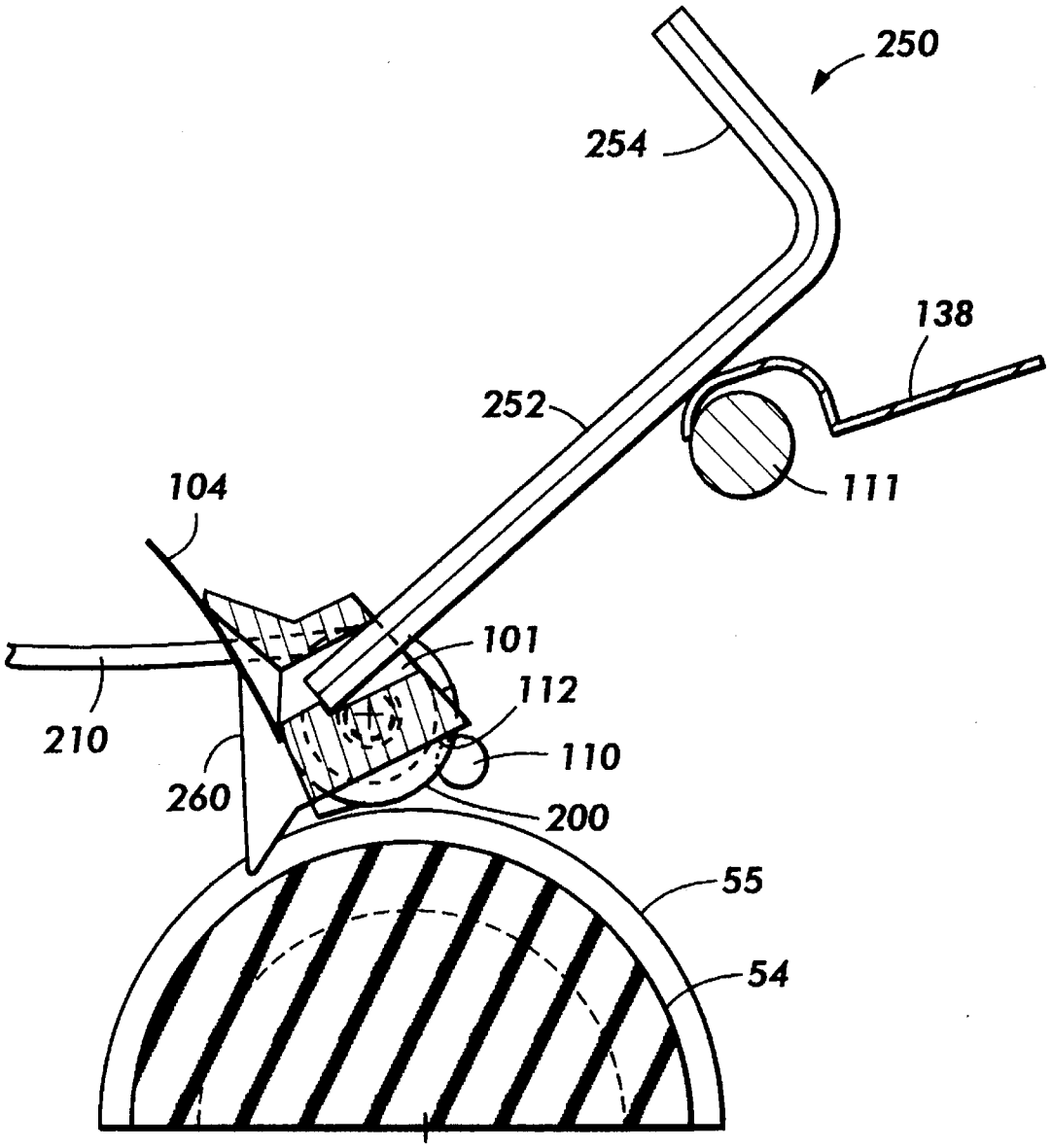
FIG. 6 is a side view of the wrench positioning mechanism for cable connection/disconnection.

The procedure to do this is as follows and it involves wrench 250 (shown in FIG. 6), in a preferred embodiment a 5 mm Allen wrench, having a long section 252 and a short section 254 at a right angles with respect to each other. With the cable connected and the fuser top cover open, the stripper bar is manually rotated counter-clockwise until the end of the long section 252 of the wrench can be inserted into aperture 101 provided in the stripper bar. The stripper bar and wrench are then allowed to rotate clockwise until the wrench rests on a cover 138 which is over a crossbar 111 which is fixed to the fuser assembly. The angle of rotation of the stripper bar, the placement and profile of the aperture in the stripper bar, the length and size of the wrench and the position of the crossbar and cover are designed so that the cable 210 is slack when the wrench is in the position shown in FIG. 6, allowing the service person to have both hands free to remove the pin 212 holding the cable to top cover link 120, thus disconnecting the cable. This configuration also allows the cable to be easily re-attached, the wrench assembly properly positioning the stripper bar for easy insertion of pin 212 into aperture 124. A special concern in this operation are paper guides 260, which will be discussed further with respect to FIG. 8.

Figure 7:
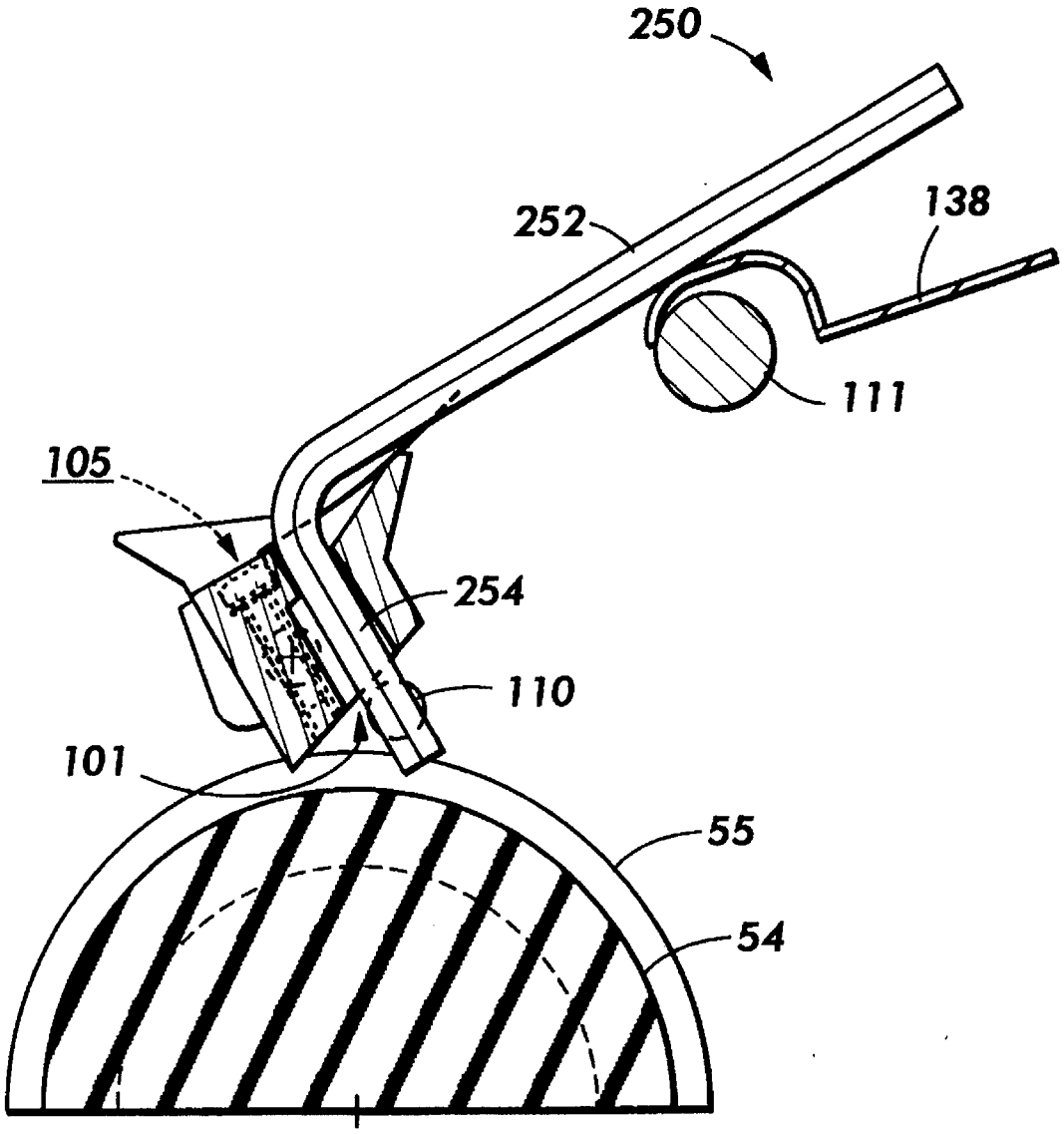
FIG. 7 is a side view of the wrench positioning mechanism for stripper bar front access.

With the pin removed and the cable disconnected, the next step in servicing the stripper fingers is to remove the wrench 250 and manually rotate the stripper bar clockwise until the aperture in the stripper bar is more or less vertical, as shown in FIG. 7. The end of short section 254 of the wrench is then inserted in aperture 101 and the long end 252 of the wrench is allowed to rest on cover 138. With the stripper bar and wrench in this configuration, the tops of connecting elements 105 are now accessible, allowing them to be removed for replacement of the stripper fingers. This entire procedure is then reversed when service is completed, leading back to the condition when the cable is attached to the top cover.

Figure 8:
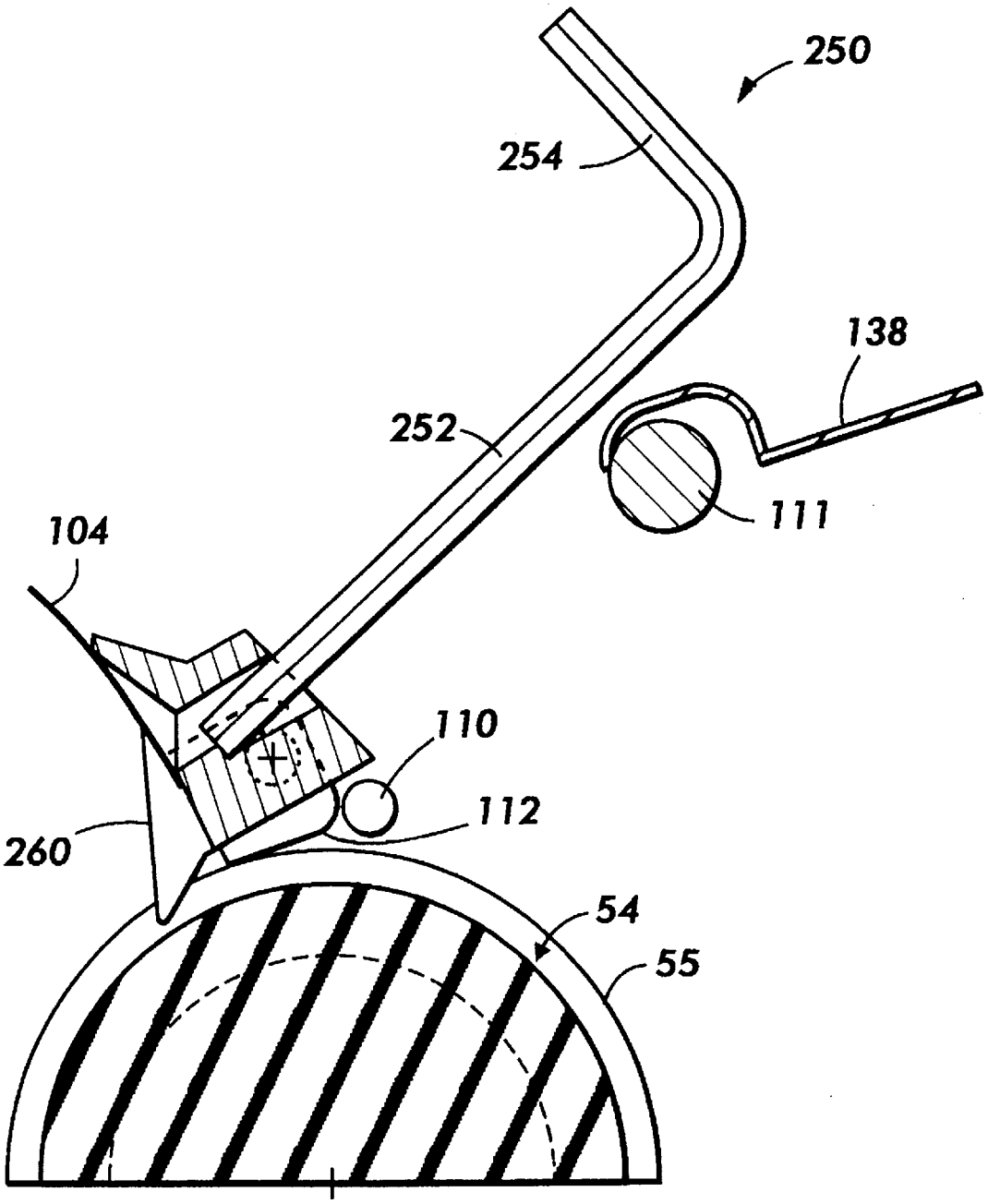
FIG. 8 is a side view of the over-rotation prevention feature.

Another additional feature incorporated into the design concerns the over-rotation of the stripper bar. As explained with reference to FIG. 6, when servicing operations are performed, the stripper bar is manually rotated past the open cover orientation in order to slacken and remove the cable. During this operation, the stripper bar be can over-rotated in the counter-clockwise direction causing the tips of the paper guides 260 to come into contact with the fuser roll 54. Paper guide contact with the fuser roll is highly undesirable because the paper guides could gouge and disfigure the fuser roll surface. In order to prevent over-rotation of the stripper bar, and as shown in FIG. 8, the stripper bar top 112 is shaped so that it contacts fuser roll bearing 55 and stops the counter-clockwise rotation of the stripper bar prior to the paper guides contacting the fuser roll surface.

It is, therefore, apparent that there has been provided in accordance with the present invention, a relatively simple cam and cable mechanism used to rotate a stripper bar assembly that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for moving a stripper bar assembly near a paper path comprising:

a housing;

at least one stripper finger;

a stripper bar having a first end and a second end, with the at least one stripper finger attached thereto, the stripper bar being rotatably mounted in the housing and near the paper path;

a cam member located at the first end of the stripper bar;

a cable having a first end and a second end, the first end of the cable attached to the cam member; and a moving member which moves from a first location to a second location, the second end of the cable being attached to the moving member so that when the moving member moves from the first location to the second location, the stripper bar rotates in a first direction and moves the at least one stripper finger away from the paper path.

2. The apparatus as claimed in claim 1, further comprising:

a top cover rotatably attached to the housing, the moving member being attached to the top cover so that opening the top cover causes the moving member to move from the first location to the second location.

3. The apparatus as claimed in claim 1, further comprising:

a spring attached to the second end of the stripper bar, the spring biasing the stripper bar to rotate in a second direction towards the paper path.

4. The apparatus as claimed in claim 3, further comprising:

a stop pin, the stop pin stopping the movement of the stripper bar in the second direction when the stripper bar contacts the stop pin.

5. The apparatus as claimed in claim 1, further comprising:

an over-rotation prevention assembly which includes a stop member and the stripper bar, the rotation of the stripper bar in the first direction being stopped when the stripper bar contacts the stop member.

6. The apparatus as claimed in claim 5, further comprising:

a fuser roll rotatably mounted in the housing by the stop member, the stop member being a bearing on an end of the fuser roll.

7. The apparatus as claimed in claim 1, wherein the stripper bar rotates at least 90 degrees in the first direction when the moving member moves from the first location to the second location.

8. The apparatus as claimed in claim 1, wherein the stripper bar rotates at least 120 degrees in the first direction when the moving member moves from the first location to the second location.

9. The apparatus as claimed in claim 1, further comprising:

a wrench having a first section with a first free end and a second section with a second free end;

a wrench resting member; and an aperture in the stripper bar, one free end of the wrench being inserted in the aperture wherein the position of the wrench controls the angle of rotation of the stripper bar.

10. The apparatus as claimed in claim 9, wherein:

the first section of the wrench and the second section of the wrench are connected by a curved section so that the first section and second sections of the wrench are at approximately 90 degrees to each other, the first section of the wrench being longer than the second section of the wrench.

11. The apparatus as claimed in claim 9, further comprising:

a first connecting member attached to the second end of the cable and a second connecting member attached to the moving member, the first connecting member being detachably connected to the second connecting member, wherein the first free end of the wrench is in the aperture and the first section of the wrench is resting on the wrench resting member so that the cable slackens and the first and second connecting members are easily disconnected from one another.

12. The apparatus as claimed in claim 9, wherein:

the second free end of the wrench is inserted in the aperture the stripper bar and the stripper bar is rotated to an intermediate angle and the first section of the wrench rests on the wrench resting member so that the stripper bar remains at the intermediate angle.

13. The apparatus as claimed in claim 1, further comprising:

a fuser roll, the stripper finger interacting with the fuser roll to prevent paper jams.

14. A method of moving a stripper bar near a paper path comprising:

rotatably mounting the stripper bar in a housing, the stripper bar having at least one stripper finger attached thereto and a cam on a first end thereof;

attaching a cable with a first end and a second end, the first end of the cable being attached to the cam end of the stripper bar and the second end of the cable being attached to a moving member; and moving the moving member from a first location to a second location, which causes the stripper bar to rotate in a first direction from a first position to a second position, causing the at least one stripper finger to move away from the paper path.

15. A method as claimed in claim 14, further comprising:

biasing the stripper bar in a second direction towards the paper path, so that when the moving member is in the first location, the at least one stripper finger is properly oriented with respect to the paper path.

16. A method as claimed in claim 14, wherein the stripper bar rotates at least 90 degrees during the moving step.

17. A method as claimed in claim 14, further comprising:

inserting a wrench having a long section and a short section connected by a curved section such that the long section and the short section are at approximately a 90 degrees with each other, the long section having a first free end and the short section having a second free end;

applying a force to the wrench; and rotating the stripper bar.

18. A method as claimed in claim 17 further comprising:

slackening the cable by inserting the first free end of the wrench in the aperture in the stripper bar and applying a force in the first direction so that the stripper bar rotates further than the second position in the first direction.

19. A method as claimed in claim 17, further comprising:

holding the stripper bar at an intermediate position between the first position and the second position by inserting the second free end of the wrench in the aperture in the stripper bar and applying a force in the second direction.

20. A method as claimed in claim 14, further comprising:

stopping the rotation of the stripper bar in the first direction with a portion of the stripper bar contacting a stop member.

* * * * *